United States Patent [19]

Robineau et al.

[11] Patent Number: 4,995,113

[45] Date of Patent: Feb. 19, 1991

[54] DEVICE FOR PROCESSING AN AUDIO-FREQUENCY ELECTRICAL SIGNAL

[75] Inventors: Philippe Robineau; Eric Vincenot, both of Paris; Didier Dal Fitto, Metz, all of France

[73] Assignee: Nexo Distribution, Paris, France

[21] Appl. No.: 358,351

[22] PCT Filed: Nov. 19, 1987

[86] PCT No.: PCT/FR87/00457

§ 371 Date: May 19, 1989

§ 102(e) Date: May 19, 1989

[87] PCT Pub. No.: WO88/04124

PCT Pub. Date: Jun. 2, 1988

[30] Foreign Application Priority Data

Nov. 21, 1986 [FR] France ..... 86 16244

[51] Int. Cl.[5] ..... H04R 3/00

[52] U.S. Cl. ..... 381/117; 381/97; 381/154; 381/156

[58] Field of Search ..... 381/97, 111, 116, 117, 381/89, 154, 156

[56] References Cited

U.S. PATENT DOCUMENTS 4,130,727 12/1978 Kates .
4,845,759 7/1989 Danley ..... 381/97

FOREIGN PATENT DOCUMENTS 0145997 6/1985 European Pat. Off. .
3507841 9/1986 Fed. Rep. of Germany .
61-264996 11/1986 Japan .

*Primary Examiner*—Forester W. Isen
*Attorney, Agent, or Firm*—Spensley Horn Jubas & Lubitz

[57] ABSTRACT

Device for processing an electrical signal for an electro-acoustic transducer such as a pressure chamber loudspeaker in particular. In accordance with the invention, the device essentially comprises means (T) for delaying the signal by a variable amount depending on its amplitude, this amount being determined by computing means (C), to compensate distortion of the sound wave resulting from the non-linear response of the transmission medium, that is to say air. The means for delaying the signal may be based on a buffer memory after digitisation of the signal.

10 Claims, 2 Drawing Sheets

DEVICE FOR PROCESSING AN AUDIO-FREQUENCY ELECTRICAL SIGNAL

The invention concerns a device for processing or pre-correcting an audio-frequency electrical signal available, for example, at the output of an amplifier and normally intended to be applied to a high-efficiency transducer such as, for example, a pressure chamber loudspeaker restricted to reproducing sounds in the so-called "upper-midband and high" frequency range.

The invention is more particularly concerned with an improvement enabling pre-compensation of the variable phase shifts affecting the emitted acoustic wave which essentially arise beyond the transducer and result from non-linear response of the propagation medium (that is to say the air).

A transmission medium such as air shows non-linear behaviour, especially when the amplitude of acoustical vibrations applied to it is high. This phenomenon is particularly audible and bothersome if the transducer is, for example, a pressure chamber (and therefore high-efficiency) loudspeaker. In this case a high level of distortion arises due to particularly bothersome spurious harmonics in the abovementioned frequency range. Now it is precisely this frequency range that a pressure chamber loudspeaker is specifically designed to handle.

Manufacturers of such loudspeakers have been obliged to design the device in such a way as to minimise such distortion, but the work done in this area has not yielded any totally satisfactory results, in particular because it has been found necessary to arrive at a compromise between two contradictory requirements concerning the dimensions of the transducer and the associated horn, namely:

- obtaining an extended frequency response and controlled directional properties implies small dimensions, whereas
- achieving low distortion implies increasing the cross-section of the "throat" of the transducer (near the pressure chamber) since for a given acoustical power the sound pressure level conditioning the distortion is inversely proportional to the cross-section.

For the purpose of improving the performance of a loudspeaker, the document DE No. 35 07 841 proposes to transpose the audio-frequency signal into the domain of Fourier transforms, to apply corrections to the Fourier transform and then to apply an inverse transformation to the signal.

This solution necessitates costly equipment. The invention proposes to treat the audio-frequency signal itself.

The invention is the result of investigation of distortion phenomena in such transducers. This work has established that:

- Virtually all distortion of the sound wave due to the non-linearity of the air occurs between the transducer and the outlet from the horn. Beyond this the wave propagates normally without significant further distortion.
- The resulting distortion of the sound wave (as compared with the electrical signal which generates it) can be regarded as a variable phase shift (that is to say a succession of "lags" or "advances") of certain parts of the sound wave, depending on the sound pressure level. The basic principle of the invention therefore consists in predicting (calculating) how such distortion of the sound wave will evolve in order to apply compensating variable time-delays to the electrical signal driving the transducer.

In this line of thinking, the invention essentially concerns a device for processing an audio-frequency electrical signal intended to be applied to an electro-acoustic transducer, in particular a high-efficiency transducer such as a pressure chamber loudspeaker, for example, characterised in that it comprises means for delaying said signal or a signal derived therefrom by an amount variable according to its amplitude, said amount changing to compensate substantially a variable propagation phase shift affecting the sound wave generated by said sound transducer.

It is feasible to implement a device of this kind in an entirely analogue version. In this case the means substantially a variable propagation phase shift affecting the sound wave generated by said transducer.

It is feasible to implement a device of this kind in an entirely analogue version. In this case the means for delaying the signal would be based on phase-shifting all-pass filters using operational amplifiers.

In practice, however, the primary intention is to operate by sampling the signal, computing simultaneously the value of the time-delay to be applied to each signal sample.

In more precise terms, the invention is therefore also concerned with a device for processing an electrical signal as defined hereinabove, characterised in that it comprises:

- sampling means receiving said signal or said signal derived therefrom and supplying successive samples thereof at its output,
- computing means with one input connected to said output of said sampling means, said computing means generating output signals representative of time-delays to be applied to respective samples, each computed time-delay being conditioned by the amplitude of the corresponding sample, and
- variable delay means comprising a control input connected to the output of the computing means and a signal input connected to the output of said sampling means.

The delay means may be based on a buffer memory, following analogue-to-digital conversion, as will be explained hereinafter, or use charge transfer devices or switched capacitor devices such as those known as "CCD" devices, which avoids analogue-to-digital conversion and subsequent digital-to-analogue conversion.

The invention will be better understood and other advantages of the invention will emerge more clearly from the following description given by way of example only and with reference to the appended drawings, in which.

Figure 1:
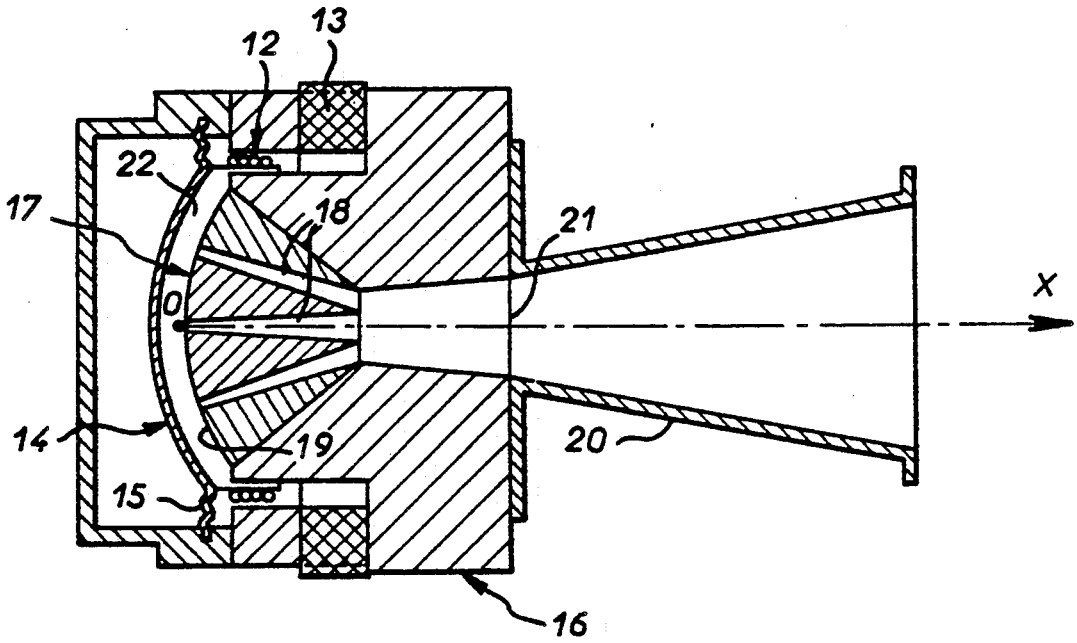
FIG. 1 is a schematic view in cross-section of a pressure chamber loudspeaker to which the invention is more particulary applicable.

Referring to the drawings, there is shown a conventional pressure chamber loudspeaker 11 to which the invention more particularly relates. This comprises a transducer comprising a moving coil 12 able to move within the airgap of a magnetic assembly 16 incorporating a permanent magnet 13 and fastened to a dome 14, a concave dome in this instance, attached to the assembly 16 by a flexible annular suspension 15. The assembly 16 includes a frustoconical part 17 in which are channels 18, in this instance annular channels, opening in the vicinity of the dome 14 onto a convex surface 19 defining with the dome 14 a pressure chamber 22. The loudspeaker is completed by a rigid horn 20 joined at the front of the assembly 16 to an orifice 21 communicating with the channels 18. The horn 20 may be of the exponential or conical type. Specific examples will be given later in relation to these two shapes, but it is obvious that the invention is applicable with the same methodology to a loudspeaker incorporating a horn of any shape. The pressure chamber 22 is therefore defined between the surface of the dome 14 and the convex surface 19. In the remainder of this document certain relationships will be expressed as a function of a distance x. In physical terms, this distance represents the abscissa of a point along the sound wave propagation axis Ox, the origin being at the forward end of the pressure chamber. As explained above, only distortion of the sound wave arising between this origin and the free end of the horn, of length L, is taken into consideration.

Consider a plane acoustic wave the acoustic velocity of which at a point with abscissa $x=0$ is any function of time $V_0(t)$: the function $V(x,t)$ representing the velocity at any point with abscissa x as a function of time t may be written:

$$V_{(x,t)} = V_0\left(t - \frac{x}{C_0}\right)$$

if the propagation medium is regarded as linear, which is a valid approximation for low amplitudes. On the other hand, this same function is expressed (to the second order) in the following form:

$$V_{(x,t)} = V_0\left(t - \frac{x}{C_0 + \frac{\gamma+1}{2} V_0}\right)$$

where $\gamma$ is a constant.

Comparing these two expressions term by term shows up the basic principle implemented in the context of the invention since to a predetermined time-delay $x/C_0$ as a function of distance in the linear case there corresponds a time-delay:

$$\frac{x}{C_0 + \frac{\gamma+1}{2} V_0}$$

if the non-linearity of the propagation medium is taken into account.

Consequently, it is exactly as if the acoustical wave at any fixed point were distorted or modulated by variable lags or advances dependent on the velocity $V_0$ at the origin. The invention enables correction of this phenomenon by applying compensatory variable time-delays to the electrical signal applied to the transducer itself.

The total distortion to be taken into consideration at the outlet from the horn (since non-linear distortion arising between the outlet from the horn and the listener can be neglected) may be determined by integration allowing for the shape of the horn. Specifically, the shape of the horn may be characterised by expressing the variation in the amplitude $v_{(x)}$ of the velocity along the propagation path Ox. If the shape of the horn can be related to an analytical function S(x) expressing the variation in the cross-section of the horn along the Ox axis, it is possible to deduce a function $v_{(x)}$ characterising the variation in the amplitude of the velocity along the propagation path Ox.

In some cases the time-delay function can itself be obtained in a relatively simple analytical form.

Thus for a conical horn of length L and with a throat cross-section S0, as defined by the equation:

$$S(x) = S_0 \cdot \left(\frac{x}{x_0}\right)^2$$

in which $x_0$ is a constant characteristic of the horn, the following equation is obtained:

$$\tau(\xi_0, L, x_0) = \frac{1}{C_0} - \xi_0 \frac{x_0}{C_0} \operatorname{Log}\left(1 + \frac{L}{x(1+\xi_0)}\right) \quad (1)$$

in which $\xi_0$ is a variable such that:

$$\xi_0 = \frac{\gamma+1}{2} \frac{V_0}{C_0}$$

For an exponential horn of length L and throat cross-section $S_0$, as defined by the equation:

$$S(x) = S_0 \cdot e^{mx}$$

in which m is a constant characteristic of the horn:

$$\tau(\xi_0, L, m) = \frac{1}{C_0} + \frac{1}{mC_0} \operatorname{Log}\left(\frac{1 + \xi_0 \exp(-mL)}{1 + \xi_0}\right) \quad (2)$$

Here the term "throat cross-section" denotes the sum of the cross-sections of the openings from the channels 18 onto the surface 19.

The application of a similar computation method may be extended to other horn shapes, the two shapes mentioned being the most usual ones: this yields other analytical expressions of the function $\tau$.

The function $\tau$ could also be determined experimentally by measuring directly distortion of the wave at the outlet from the horn. It would then be possible to establish an approximate mathematical function expressing the relationship between the measured values of $\tau$ and the corresponding values of $V_0$. This method would enable application of the correction device in accordance with the invention to all complex horn shapes.

The previously mentioned computing means could then be adapted to reproduce electrically the shape of the function $\tau$ corresponding to the shape of $\tau$.

Figure 2:
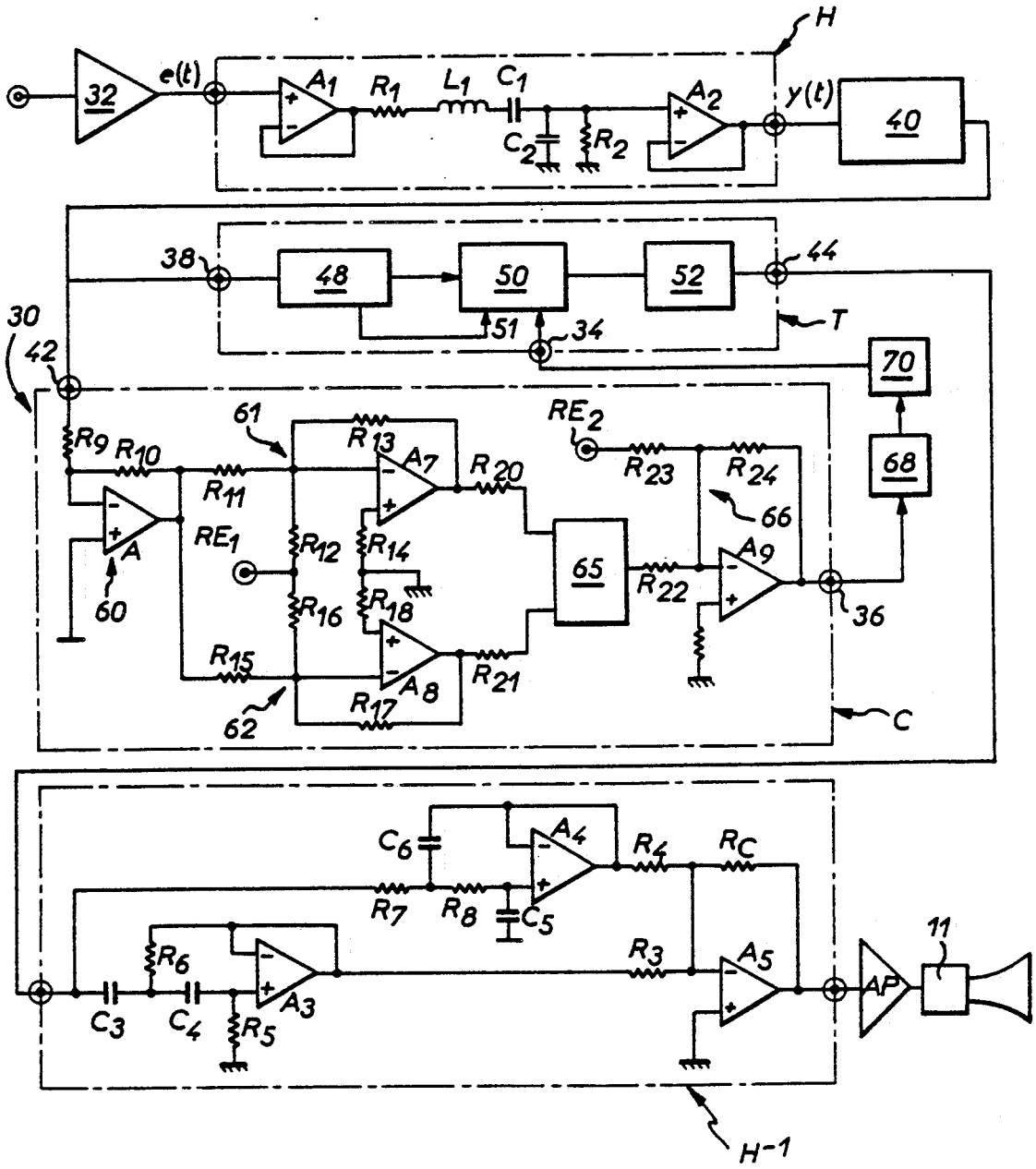
FIG. 2 is a block schematic of one possible embodiment of a signal processing device in accordance with the invention.

Since the time-delays can only be applied to the electrical signal and not to the emitted acoustic wave, it is necessary to apply the transformation defined by one of the above equations not to the electrical signal e(t) itself, as supplied by the amplifier, but rather to a signal y(t) derived or deduced from it and proportional to the acoustic velocity $V_0(t)$. This is achieved physically by applying the electrical signal to a first filter H having a transfer function at least approximately equivalent to that of said transducer. In other words, H is the electrical equivalent of the transfer function of the transducer including the pressure chamber. Determining the design and electrical component values of a filter of this kind is within the normal competence of those skilled in the art given the mechanical parameters of the component parts of the transducer. The basic structure of a signal processing device in accordance with the invention is completed by variable delay means controlled by the computing means and receiving the signal delivered by the filter H. A complete device of this kind is shown in FIG. 2.

In this schematic the electrical signal processing device 30 is inserted between means generating the electrical signal e(t), in this instance a low-frequency pre-amplifier 32, and the transducer of the pressure chamber loudspeaker 11 described above. A linear power amplifier AP is inserted between the output of the processing device and the loudspeaker 11. The signal processing device includes the filter H, the computing means C "simulating" electrically one of the equations given above, in this instance the equation (2) relating to an exponential horn loudspeaker, and variable delay means T having a control input 34 connected to the output 36 of the computing means C and a signal input 38 connected to the output of the first filter H through sampling means 40. The output of the sampling means is connected to the input 42 of the computing means so that the signal transformed by the filter H and representative of the velocity of the sound wave "to be corrected" is applied both to the input of the computing means C and to the input of the delay means T. The output 44 of the latter is connected to a second filter $H^{-1}$, having a transfer function at least approximately the inverse of that of said first filter H.

In a simplified version it would be feasible to insert only the delay means T between the pre-amplifier 32 and the transducer 11. The control loop for said delay means (comprising only a cascade combination of the first filter H and the computing means C) would be connected between the output of the amplifier 32 and the input 34.

Returning now to the particular version of FIG. 2, the implementation of each of the subsystems mentioned above will be described in more detail.

As already explained, the filter H is merely the electrical "transcription" of the transfer function of the transducer 11. Its output signal y(t) is therefore representative of the acoustic wave generated by the transducer 11 up to the outlet from the pressure chamber. It incorporates a series branch comprising a resistor $R_1$, an inductor $L_1$ and a capacitor $C_1$ followed by a capacitor $C_2$ and a resistor $R_2$ connected in parallel to earth. The combination of these series and shunt branches is inserted between two unity gain matching amplifiers $A_1$ and $A_2$.

As previously mentioned, computing the values for the passive components $R_1$, $L_1$, $C_1$, $C_2$, $R_2$ is within the competence of those skilled in the art given the transfer function of the transducer up to the pressure chamber.

The transfer function of the second filter $H^{-1}$ is the inverse of that of the filter H. The second filter comprises three operational amplifiers $A_3$, $A_4$, $A_5$. The signal supplied by the delay means is applied to the respective inputs of a second order high-pass filter based on the operational amplifier $A_3$ and a second order low-pass filter based on the amplifier $A_4$. The outputs of these two filters are applied to a conventional summing circuit via two resistors $R_3$, $R_4$ connected to the inverting input of the amplifier $A_5$ which is associated with a feedback resistor $R_C$. The high-pass filter includes a series branch comprising two capacitors $C_3$, $C_4$ connected to the non-inverting input of the amplifier $A_3$, a resistor $R_5$ connected between this input and earth and a resistor $R_6$ connected between the common point of the two capacitors and the inverting input of the amplifier. Total feedback is applied to the amplifier. Similarly, the low-pass filter includes a series branch comprising resistors $R_7$, $R_8$ connected to the non-inverting input of the amplifier $A_4$, a capacitor $C_5$ connected between this input and earth and a capacitor $C_6$ connected between the common point of the two resistors and the inverting input of the amplifier $A_4$. Total feedback is applied to the amplifier.

In the example shown, the variable delay means comprise a cascade circuit comprising an analogue-to-digital converter 48 the input of which is coincident with the input 38 and is therefore connected to the output of the sampler 40, a buffer memory 50 and a digital-to-analogue converter 52. The memory 50 has a write control input 51 driven by the converter 48 to write the data at a predetermined rate and a read control input coincident with the control input 34. The pulses present at this input are conditioned by the signal supplied by the computing means and these pulses condition reading of the memory at a variable rate. Said buffer memory 50 is of the "FIFO" type, for example, meaning that the first information to be written into memory is also the first information to be fetched from memory after a variable time-delay depending on the frequency of the pulses applied to the read control input. The reconstituted analogue signal at the output of the converter 52 is applied to the input of the filter $H^{-1}$ before it is passed to the transducer 11.

The combination of the memory 50 and the two converters 48 and 52 could be replaced with a cascade circuit of switched capacitor components ("CCD" type).

The computing means C receive successive samples of the signal y(t). They include a first amplifier stage 60 incorporating an operational amplifier $A_6$ and two resistors $R_9$, $R_{10}$. The resistor $R_9$ is connected between the input 42 and the inverting input of the amplifier $A_6$. $R_{10}$ is a feedback resistor. The gain of the amplifier $A_6$, defined by the resistors $R_9$ and $R_{10}$, is representative of the constant:

$$\frac{\gamma + 1}{2\,C_0}$$

The output of the amplifier stage 60 is therefore representative of $\xi_0$ for each sample supplied by the sampler 40. This output is connected to the inputs of two summing circuits 61, 62. The circuit 61 includes a resistor $R_{11}$ connected between the output of the stage 60 and the inverting input of an operational amplifier $A_7$ and a resistor $R_{12}$ connected between a voltage reference $RE_1$ and the same inverting input. $R_{13}$ is a feedback resistor. A resistor $R_{14}$ is connected between the non-inverting input of the amplifier $A_7$ and earth. The voltage reference $RE_1$ is representative of the value 1 and the resistor values are chosen to produce a voltage representative of $1+\xi_0$. The summing circuit 62 includes an operational amplifier $A_8$ and resistors $R_{15}$ through $R_{19}$ respectively connected in the same way as the amplifier $A_7$ and the resistors $R_{11}$ through $R_{14}$. The resistor values are chosen to produce a voltage representative of:

$$1+\xi_0 \exp(-mL)$$

The outputs of the two summing circuits are connected by respective resistors $R_{20}$, $R_{21}$ to two inputs of a known circuit 65 including two logarithmic amplifiers and a differential amplifier. This circuit therefore generates a voltage representative of:

$$\frac{1}{mC_0} \text{Log}\left(\frac{1+\xi_0 \exp(-mL)}{1+\xi_0}\right)$$

This voltage is applied to an input of another summing circuit 66 including an operational amplifier $A_9$ and resistors $R_{22}$ through $R_{25}$ connected in the same way as the resistors $R_{11}$ through $R_{14}$. The resistor $R_{23}$ is connected to a voltage reference $RE_2$ representative of the value $1/C_0$. The output of the amplifier $A_9$, coincident with the output 36, is therefore representative of the time-delay $\tau$ to be applied in the case of an exponential horn loudspeaker. The output 36 is connected to a known analogue divider 68 which is biased to generate an output voltage representative of $1/\tau$. (having the dimension of frequency) and the output of which is connected to the input of a voltage-to-frequency converter 70 supplying pulses to the read control input 34 of said variable delay means T. The constant time-delay to be applied systematically to the samples passing through the delay means may be produced by a monostable integrated into the converter 70 and by having the memory 50 read on the trailing edges of the pulses.

The operation of the device is obvious from the foregoing description. The signal delivered by the amplifier 32 is filtered by the first filter H before being sampled. Each sample is delayed by a variable amount computed simultaneously by the computing means C as a function of its amplitude. The samples processed in this way are then applied in succession to the loudspeaker 11 via the second filter $H^{-1}$.

Figure 3:
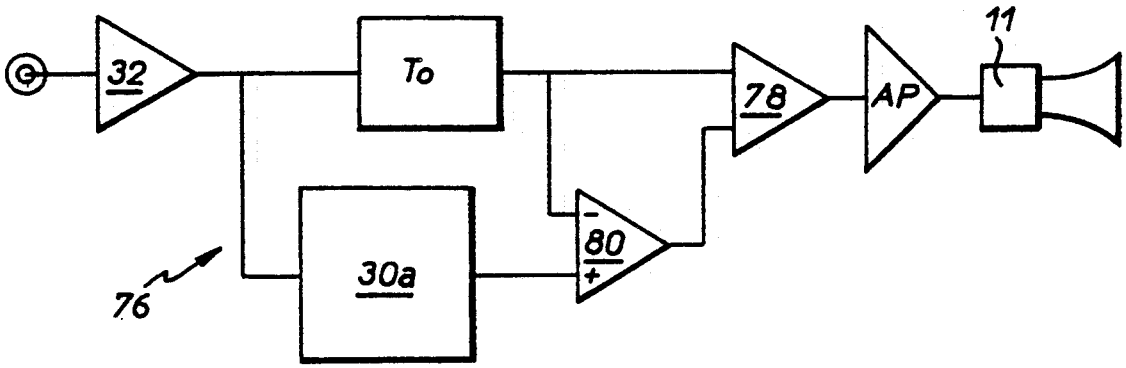
FIG. 3 is a simplified block schematic showing a possible alternative embodiment of the signal processing device.

The circuit of FIG. 3 may be used to avoid any risk of introducing spurious switching noise between the pre-amplifier 32 and the loudspeaker 11. In this embodiment the pre-correction device 30*a* is similar to that which has just been described with reference to FIG. 2 but is connected in a correction loop 76 which shunts the path of the signal between the output of the amplifier 32 and the loudspeaker 11. Fixed delay means $T_0$ are connected between the output of the amplifier 32 and the input of a summing amplifier 78 whose output drives the loudspeaker 11. By means of a differential amplifier 80 the output of the pre-correction circuit is combined with the output of the delay means $T_0$ and the resulting correction signal is applied to another input of the summing amplifier 78.

We claim:

1. Device for processing an audio-frequency electrical signal intended to be applied to an electro-acoustic transducer, characterised in that it comprises means (T) for receiving said audio-frequency signal (e(t)) or a signal (y(t)) derived therefrom and to delay it by a variable amount depending on its amplitude, said amount changing to compensate substantially a variable propagation phase-shift affecting the sound wave generated by said transducer.

2. Processing device according to claim 1 characterised in that it comprises:

sampling means (40) receiving said signal or said derived signal and delivering successive samples thereof to its output, computing means (C) with one input (42) connected to said output of said sampling means, said computing means generating output signals representative of time-delays to be applied to respective samples, each computed time-delay being conditioned by the amplitude of the corresponding sample, and variable delay means comprising a control input (34) connected to the output of the computing means and a signal input (38) connected to the output of said sampling means (40).

3. Processing device according to claim 2 characterised in that a first filter (H) is inserted on the input side of said computing means, said filter having a transfer function at least approximately equivalent to that of said transducer.

4. Processing device according to claim 3 characterised in that said first filter (H) is inserted on the input side of said computing means (C) and also on the input side of said variable delay means (T).

5. Processing device according to claim 4 characterised in that a second filter ($H^{-1}$) is inserted on the output side of said delay means, said second filter having a transfer function which is at least approximately the inverse of that of said first filter.

6. Processing device according to claim 2 characterised in that said delay means (T) comprise a cascade circuit including an analogue-to-digital converter (48) the input of which is connected to the output of said sampler, a buffer memory (50) having a write control input (51) and a read control input (34) and a digital-to-analogue converter (52), said read control input being connected to the output of said computing means (C) via a voltage-to-frequency converter (70).

7. Processing device according to claim 2 characterised in that said delay means (T) essentially comprise a cascade circuit of switched capacitor or "CCD" components.

8. Processing device according to claim 1 characterised in that it is inserted between means (32) for generating the electrical signal and said transducer (11) (FIG. 2).

9. Processing device according to claim 1 characterised in that it is inserted in a correction loop (76) between means (32) for generating the electrical signal and one input of summing means (78), another input of said summing means being connected to said signal generation means via fixed delay means ($T_0$).

10. The device of claim 1 wherein said transducer is a pressure chamber loudspeaker.

* * * * *